US006763526B1

(12) United States Patent
Hong

(10) Patent No.: US 6,763,526 B1
(45) Date of Patent: Jul. 20, 2004

(54) AIR VENT STRUCTURE FOR HELMET

(75) Inventor: Seong-Kug Hong, Kyunggi-do (KR)

(73) Assignee: HJC Co., LTD, Kyunggi-do (KR)

( * ) Notice: Subject to any disclaimer, the term of this patent is extended or adjusted under 35 U.S.C. 154(b) by 0 days.

(21) Appl. No.: 10/423,817

(22) Filed: Apr. 25, 2003

(30) Foreign Application Priority Data

Mar. 24, 2003 (KR) ..... 2003-0018246

(51) Int. Cl.[7] ..... A42B 1/00
(52) U.S. Cl. ..... 2/171.3; 2/424
(58) Field of Search ..... 2/171.3, 436, 437, 2/424, 410, 422, 425

(56) References Cited

U.S. PATENT DOCUMENTS 4,081,865 A * 4/1978 Bergee et al. ..... 2/425
5,170,511 A * 12/1992 Kamata ..... 2/424
5,212,843 A * 5/1993 Kamata ..... 2/424
5,345,614 A * 9/1994 Tanaka ..... 2/425
5,388,278 A * 2/1995 Taniuchi ..... 2/422
6,105,172 A * 8/2000 Shida ..... 2/171.3
6,263,513 B1 * 7/2001 Murakami ..... 2/171.3
6,405,382 B2 * 6/2002 Shida ..... 2/171.3

* cited by examiner

*Primary Examiner*—Rodney M. Lindsey
(74) *Attorney, Agent, or Firm*—R. Neil Sudol; Henry D. Coleman; William J. Sapone

(57) ABSTRACT

The present invention relates to an air vent structure for an inner air discharge of a helmet adapted to protect a user's head when a user rides a motorcycle, and in particular to an air vent structure for a helmet which is capable of preventing a breath steam from forming in an inner surface of a shield by installing an air vent in lower both sides of a shield installed in a front side of a helmet and accurately adjusting an opening and closing degree of an air vent. It is a primary object of the present invention to provide an air vent structure for a helmet which is capable of discharging an inner air based on the flow of an air of an air vent by installing an air vent at both lower sides of a shield of a helmet, improving a structure of an air flow of an air vent and accurately adjusting the amount of flowing air, and it is possible to adjust the flowing amount of air based on a helmet user's condition and a state of an inner and outer side of a helmet for thereby implementing a pleasant state.

7 Claims, 9 Drawing Sheets

【Fig.1】 Prior Art
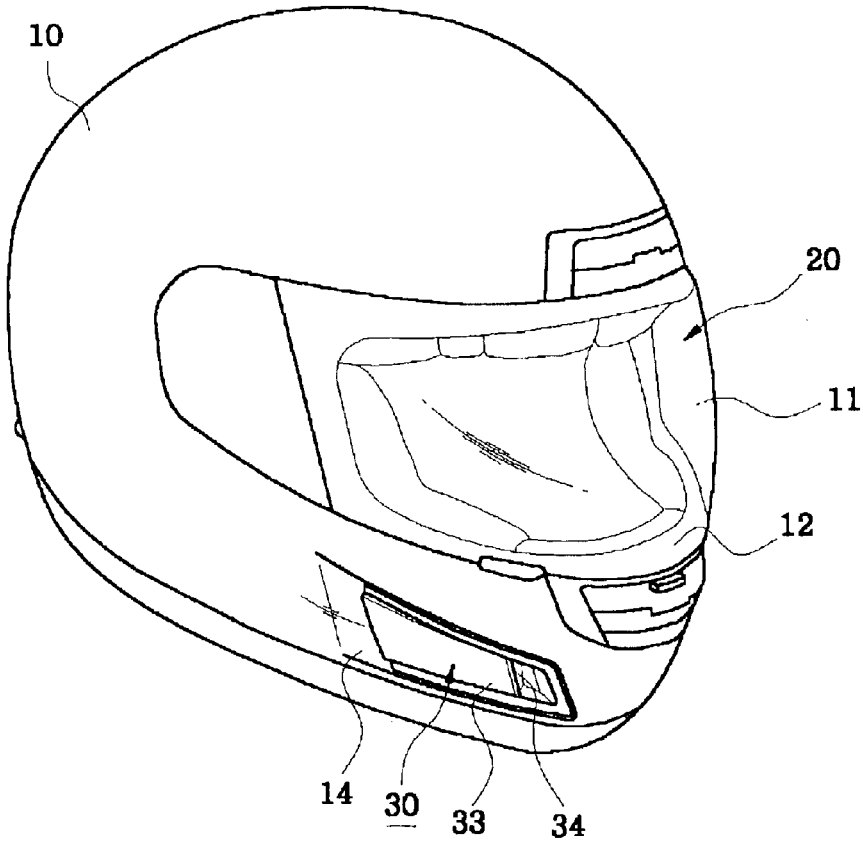

【Fig.2】 Prior Art
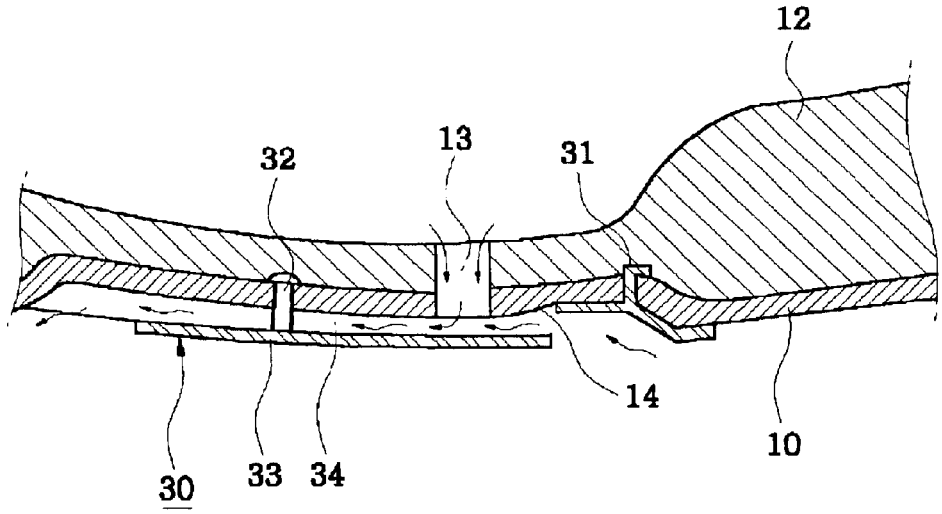

【Fig.3】
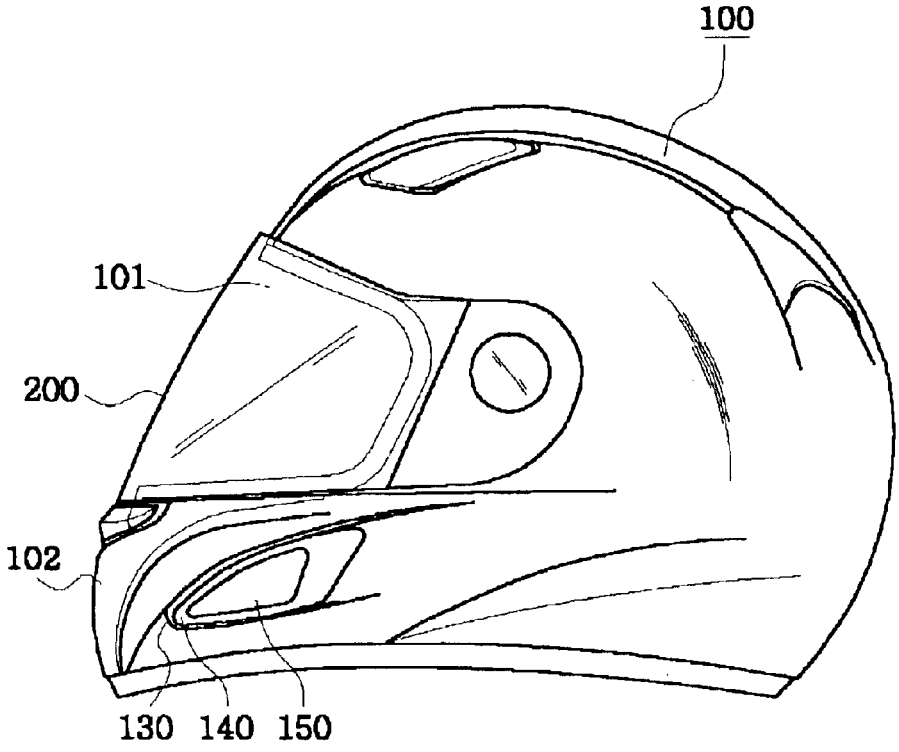

【Fig.4】
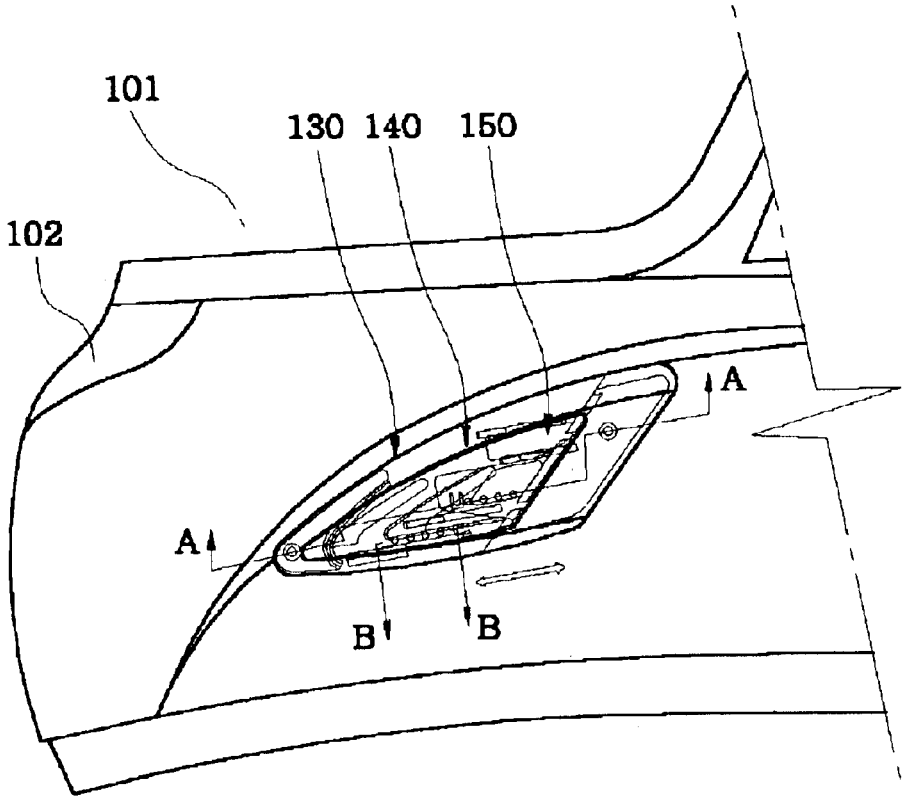

[Fig.5]
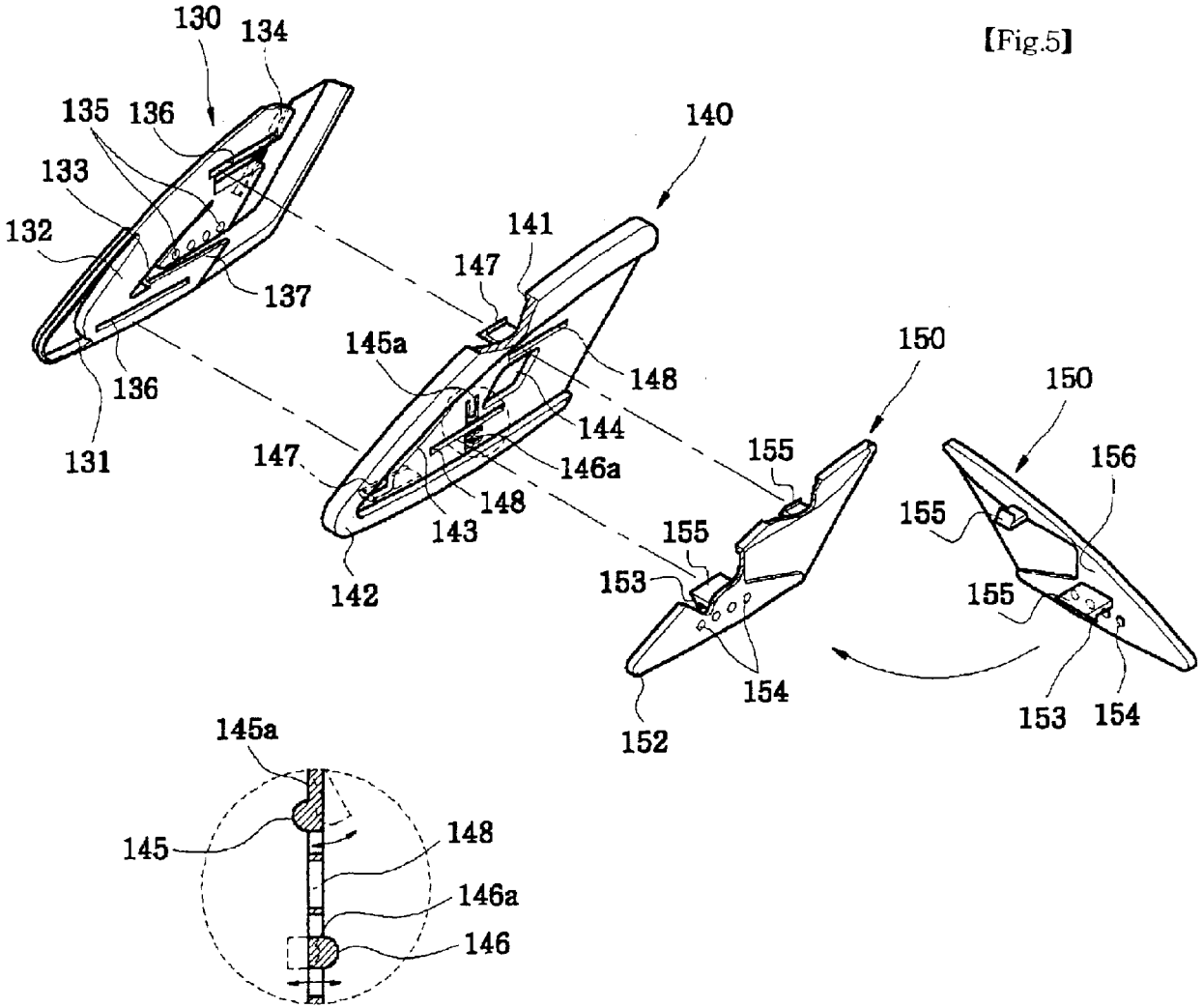

[Fig.6]
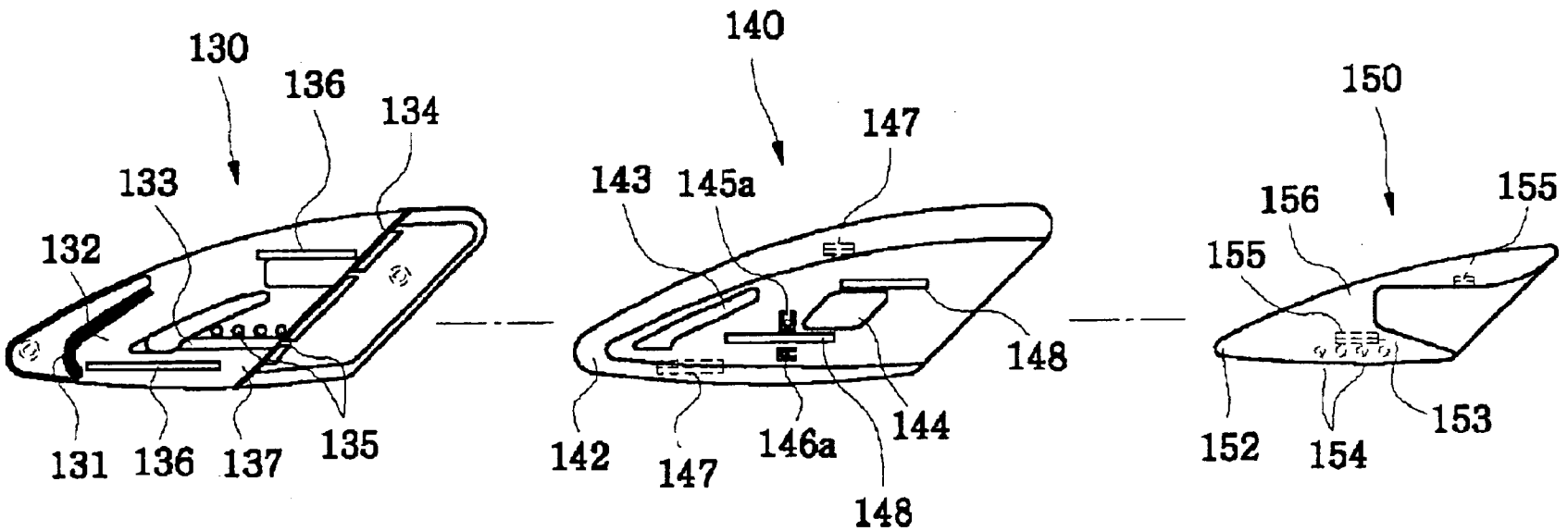

【Fig.7】
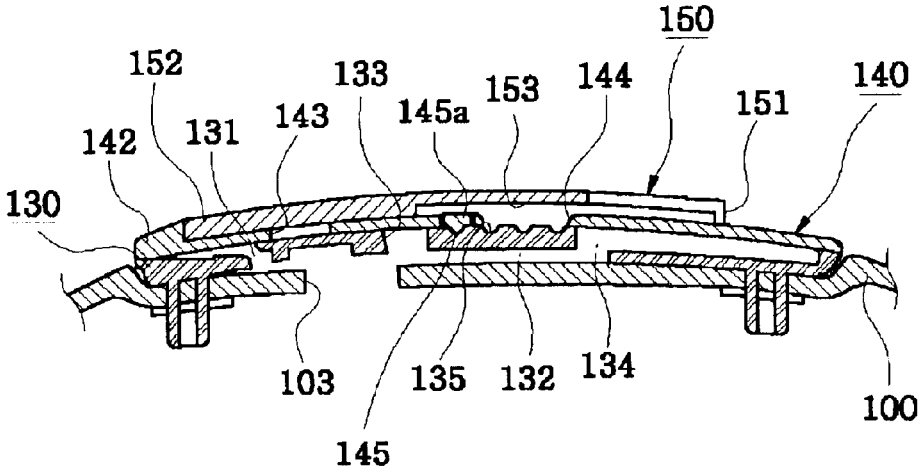
【Fig.8】
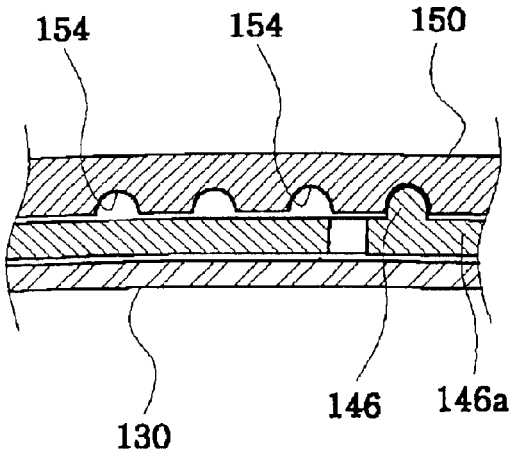

【Fig.9】
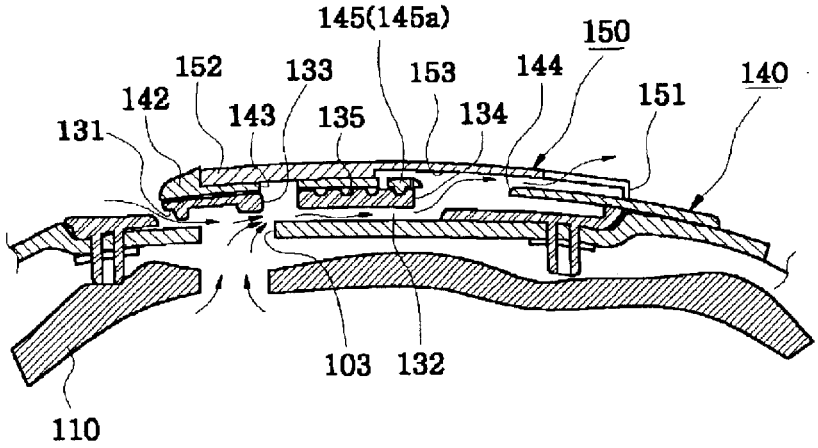
【Fig.10】
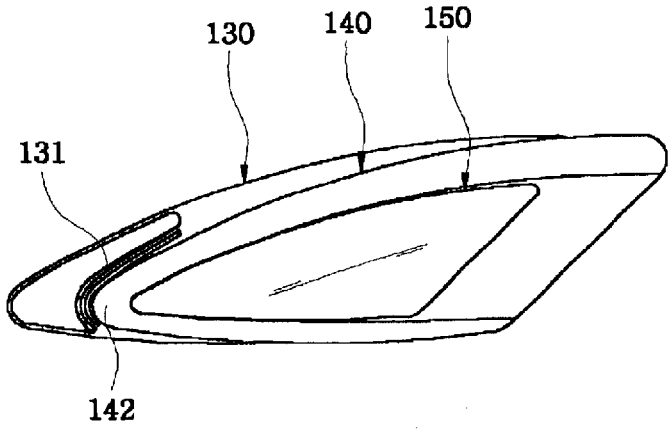

【Fig.11】
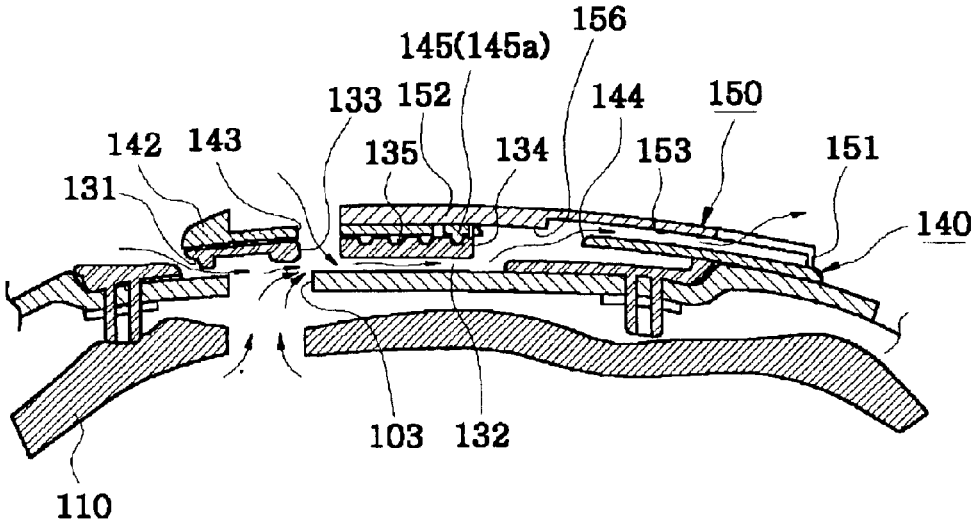
【Fig.12】
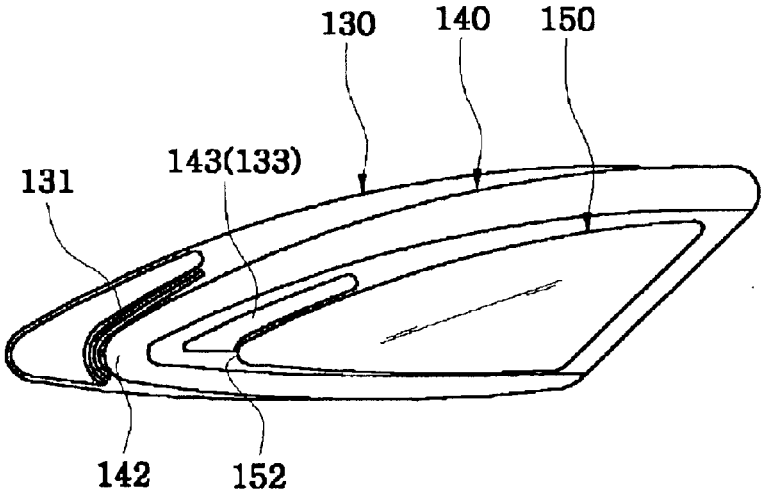

AIR VENT STRUCTURE FOR HELMET

BACKGROUND OF THE INVENTION

1. Field of the Invention

The present invention relates to an air vent structure for an inner air discharge of a helmet adapted to protect a user's head when a user rides a motorcycle, and in particular to an air vent structure for a helmet which is capable of preventing a breath steam from forming in an inner surface of a shield by installing an air vent in lower both sides of a shield installed in a front side of a helmet and accurately adjusting an opening and closing degree of an air vent.

2. Description of the Background Art

Generally, when a person rides a two-wheeled vehicle, the person must wear a head protecting helmet for protecting a rider's head. In the case of a full face helmet which covers up to a jaw portion of a user, a front shield must be installed.

The above shield is capable of preventing any interference in a field of vision by a wind force which occurs when a vehicle runs in a certain direction and preventing a breathing difficulty and obtaining a warm keeping effect in the winter season.

However, since the conventional helmet having a shield does not have an air vent for discharging an inner air to the outside, there are the following problems.

Namely, when a shield is dropped down for thereby shielding a forward field of vision of the helmet, the shield is capable of preventing a wind which is flown in a running direction and overcoming a breathing problem. However, in the case that there is a big temperature difference between the inner side and outside of the helmet like in the winter season, a breath steam may be formed in an inner surface of the shield due to a user's breathing, so that the user's field of vision becomes bad.

In addition, in order to overcome the above problems, various air vent ways are developed for thereby discharging an inner air to the outside. As one of the ways, the applicant of the present invention filed a patent No. 10-0299319 (hereinafter, it is referred to as Prior art).

As shown in FIGS. 1 and 2, there is prepared a helmet body 10 which has a padding 12 in the interior of the same and a shield 20 in a front opening portion 11. At the both front sides of the helmet body 10, a communicating hole 13 is formed in the padding 12, and a groove 14 is formed in such a manner that the communication hole 13 is positioned in the center.

In addition, an air vent member 30 is installed in such a manner that the air vent member is closely fixed to the groove 14, and one end of the same is fixed by an engaging shoulder portion 31, and the other end of the same is engaged by an engaging unit 32, and a cover portion 33 is formed thereon for thereby forming a communicating portion 34.

According to the above described prior art, the air which flows from the front side to the side of the helmet body 10 flows along an inner side of the cover portion 33 of the air vent member 30, namely, along the inner side of the communicating portion 34 for thereby sucking an inner air of the communication hole 13 and discharging the sucked air (based on Vernoulli's theorem for a fluid).

However, in the air vent structure of the above prior art, the air is guided to flow in an inner side of the cover portion of the air vent member. There is provided only an opening and closing portion for opening and closing the guide portion. Therefore, when discharging an inner air, the amount of the air discharged is not controlled.

In detail, the size of the communicating hole 13 and the cross sectional area of the communication portion 34 are fixed, namely, unchangeable, the amount of the air flowing along the communicating portion 34 is constant. Therefore, the amount of the inner air discharged through the communication hole 13 is constant.

In the case that the formation of the breath steam is increased in the shield, the discharging amount of the air is not increased. In addition, in the case that the formation of the breath steam is small, it is impossible to decrease the discharging amount of the air for keeping warm.

SUMMARY OF THE INVENTION

Accordingly, it is an object of the present invention to provide an air vent structure for a helmet which overcome the problems encountered in the conventional art.

It is another object of the present invention to provide an air vent structure for a helmet which is capable of discharging an inner air based on the flow of an air of an air vent by installing an air vent at both lower sides of a shield of a helmet, improving a structure of an air flow of an air vent and accurately adjusting the amount of flowing air, and it is possible to adjust the flowing amount of air based on a helmet user's condition and a state of an inner and outer side of a helmet for thereby implementing a pleasant state.

In order to achieve the above objects, there is provided an air vent for a helmet which includes a helmet body which includes a front opening portion, a shield installed in such a manner that the opening portion is openable, a pad provided in a whole inner surface, and a communicating hole which is formed at right and left sides of a jaw protection portion in a lower portion of the opening portion and communicates with the outside; a base member which is fixed in such a manner that an outer portion of the communicating hole of the helmet body is covered, and which includes a first air inlet hole formed in a front side of the helmet, a first air moving space portion formed from the first air inlet hole to a rear side, a second air inlet hole formed in such a manner that more air is flown into the first air moving space portion, and a plurality of first air outlet holes formed in a rear side of the air moving space portion; a door base member which is slidable on the base member in a forward and backward direction in a state that a first inward rim closely is contacted with an outer surface of the base member and the first air inlet hole is opened and closed by a first end portion opens during the sliding, and which includes a third air inlet hole formed in an inner side of a first end portion and a second air outlet hole formed in a rear side at a certain distance from the third air inlet hole; and a side door member which is slidable on the door base member in a forward and backward direction in a state that a second inward rim is closely contacted with an outer surface of the door base member and the second air inlet hole is opened and closed by a second end portion during the sliding, and which includes a second air moving space portion in a rear side.

BRIEF DESCRIPTION OF THE DRAWINGS

The present invention will become better understood with reference to the accompanying drawings which are given only by way of illustration and thus are not limitative of the present invention, wherein;

FIG. 1 is a perspective view illustrating the construction of a conventional helmet;

FIG. 2 is a cross sectional view illustrating the construction of a conventional helmet;

FIG. 3 is a side view illustrating a helmet having an air vent apparatus according to the present invention;

FIG. 4 is a front view illustrating an air vent portion of FIG. 3 according to the present invention;

FIG. 5 is a disassembled perspective view illustrating a structure of an air vent structure according to the present invention;

FIG. 6 is a front view and bottom view illustrating each element of FIG. according to the present invention;

FIG. 7 is a plan cross sectional view illustrating an installation state according to the present invention;

FIG. 8 is a cross sectional view taken along line B—B of FIG. 4 according to the present invention;

FIG. 9 is a cross sectional view taken along line A—A of FIG. 4 for explaining an operation of a first opening step according to the present invention;

FIG. 10 is a front view illustrating an air vent structure based on a first opening step of FIG. 9 according to the present invention;

FIG. 11 is a cross sectional view taken along line A—A of FIG. 4 for explaining an operation of a second opening step according to the present invention; and FIG. 12 is a front view illustrating an air vent structure based on a second opening step of FIG. 11 according to the present invention.

<Descriptions of reference numerals of major elements of the drawings>

| | | | |
|---|---|---|---|
| 100: | helmet body | 101: | opening portion |
| 102: | jaw protection portion | 103: | communicating hole |
| 110: | pad | 130: | base member |
| 131: | first air inlet hole | 132: | first air moving space portion |
| 133: | second air inlet hole | 134: | first air outlet hole |
| 135: | first groove | 136: | first guide hole |
| 137: | first protrusion | 140: | door base member |
| 141: | first inward rim | 142: | first end portion |
| 143: | third air inlet hole | 144: | second air outlet hole |
| 145: | first stopper protrusion | 145a: | first elastic piece |
| 146: | second stopper protrusion | 146a: | second elastic piece |
| 147: | first engaging protrusion | 148: | second guide hole |
| 150: | side door member | 151: | second inward rim |
| 152: | second end portion | 153: | second air moving space portion |
| 154: | second groove | 155: | second engaging protrusion |
| 156: | second protrusion | | |

DETAILED DESCRIPTION OF THE PREFERRED EMBODIMENTS

The construction and operation of the present invention will be described with reference to the accompanying drawings.

FIG. 3 is a side view illustrating a helmet having an air vent apparatus according to the present invention, FIG. 4 is a front view illustrating an air vent portion of FIG. 3 according to the present invention, and FIG. 5 is a disassembled perspective view illustrating a structure of an air vent structure according to the present invention.

As shown therein, the air vent structure for a helmet according to the present invention is installed in a helmet body 100 which includes a front opening portion 101, a shield 200 adapted to opening and closing the opening portion, a pad 110 provided in all inner portions, and a communicating hole 103 which is formed in the left and right sides of a jaw protection portion 102 provided in a lower portion of the opening portion for thereby communicating with the outside.

In addition, the air vent according to the present invention installed in an outer portion of the communicating hole 103 includes a base member 130, a door base member 140 and a side door member 150.

The base member 130 which is fixed to cover an outer surrounding portion of the communicating hole 103 of the helmet body 100 includes a first air inlet hole 131 formed in a front side of the helmet, a first air moving space portion 132 which communicates from the first air inlet hole to rear side, a second air inlet hole 133 formed in such a manner that more air is flown into the first air moving space portion 132, and a plurality of first air outlet holes 134 formed in a rear side of the air moving space portion.

The door base member 140 is slidably moved in a forward and backward direction in a state that a first inward rim 141 is closely contacted with an outer surface of the base member 130, so that a first end portion 142 of the same opens and closes the first air inlet hole 131. The door base member 140 includes a third air inlet hole 143 formed in the inner side of the first end portion, and a second air outlet hole 144 formed in a rear side at a certain distance from the third air inlet hole.

In addition, the side door member 150 is slidably moved in a forward and backward direction in a state that a second inward rim 151 is closely contacted with an outer surface of the door base member 140, so that the second end portion 152 opens and doses the second air inlet hole 133. A second air moving space portion 153 is formed in the rear side.

The assembling and sliding structure will be described with reference to FIGS. 5 through 7.

Namely, the door base member 140 is slidable on the base member 130 and includes at least a pair of first engaging protrusions 147 in the inner side surface of the same. The first engaging protrusion 147 is slidable in a forward and backward direction along the pair of the first guide holes 136 formed in the bottom of the base member 130.

In addition, the side door member 150 is slidable on the door base member 140 and includes at least a pair of second engaging protrusions 155 in the inner side surface of the same. The second engaging protrusions 155 are slidable in a forward and backward direction along the pair of the second guide holes 148 formed in the bottom of the door base member 140.

In particular, the door base member 140 and the side door member 150 are slidably opened and closed on the base member 130 and the door base member 140, respectively, and have the multiple stop points.

Namely, the door base member 140 includes a first inward stopper protrusion 145 and a first elastic piece 145*a* adapted to generate al elastic force to the first stopper protrusion 145 and stops whenever the first stopper protrusion 145 contacts with more than at least three first grooves 135 arranged in an outer surface of the base member 130 in a sliding direction at a regular interval.

In addition, the side door member 150 includes more than at least three second grooves 154 arranged in an inner surface in a sliding direction at a regular interval and stops whenever the second grooves 154 formed in an outer surface of the door base member 140 contact with the second elastic piece 146*a* having the second stopper protrusion 146

The side door member 150 has a second protrusion 156 in a lower portion of the upper side engaging protrusion 155 in a horizontal direction for limiting a retraction of the first elastic piece 14*a* in a certain section, and the base member 130 has a first protrusion 137 on the first lower side guide hole 136 in a horizontal direction for limiting a retraction of the first elastic piece 146*a* in a certain section.

The operation of the present invention will be described as follows.

A pair of the first guide holes 136 is formed in the base member 130 in a longitudinal direction. An end portion of each of the pair of the first engaging protrusions 147 of the door base member 140 inserted therein is formed in a wedge engaging shoulder shape. Therefore, when the end portion of the same is pressed from the upper side, the end portion of the same is inserted through the first guide hole 136. After the end portion of the same is inserted therein, the end portion of the same is not disconnected.

Since the second engaging protrusion 155 of the side door member 150 is also formed in a wedge engaging shoulder shape, when the second engaging protrusion 155 is inserted into the pair of the second guide holes 148 formed in the door base member 140 in the longitudinal direction, the second engaging protrusion 155 is not disconnected In addition, the first stopper protrusion 145 formed in the first elastic piece 145*a* in the door base member 140 may be engaged by the plurality of the first grooves 135 formed in the base member 130 and may be stopped at the engaged positions when the door base member 140 slides on the vase member 130. In addition, a retraction operation of the first elastic piece 145*a* may be limited by the second protrusion 156 formed in a lower portion of the upper side engaging protrusion 155 in the side door member 150 in a certain section.

The above construction is provided so that the door base member 140 is closed after the side door member 150 is closed.

In addition, the door base member 140 may be engaged by a plurality of second grooves 154 formed in the side door member 150 and may stop at the engaged positions when the side door member 150 slides on the door base member 140. A retraction operation of the first elastic piece 146*a* may be limited by the first protrusion 137 formed on the first lower side guide hole 136 in the base member 130 in a certain section.

The above construction is provided so that the side door member 150 is opened after the door base member 140 is opened.

The state of use of the present invention will be described.

The opening and closing steps based on the air vent according to the present invention is formed of a first opening step in which only the door base member 140 is opened in a state that the side door member 150 is closed, and a second opening step in which the side door member 150 is opened in a state that the door base member 140 is opened. Each of first and second opening steps may have four sub-steps, respectively.

For example, when a discharge of the inner air is not needed based on a helmet user's judgement, the door base member 140 sliding in the base member 130 and the side door member 150 sliding in the door base member 140 are all forwardly moved and closed.

As shown in FIG. 7, the second end portion 152 of the side door member 150 blocks the third air inlet hole 143 of the door base member 140. In this state, the first end portion 142 of the door base member 140 blocks the first air inlet hole 131 of the base member 130. In addition, since the second air inlet hole 133 of the base member 130 is blocked by an intermediate portion of the door base member 140, the air flows along only an outer surface, not along an inner side.

Therefore, the inner air of the helmet does not flow to the outside through the communicating hole 103.

As shown in FIGS. 9 and 10, in the above state, in the first opening step, only the door base member 140 is retracted on the base member 130 for thereby implementing an opening operation.

In a state that the side door member 150 is closed, when the door base member 140 is retracted, the side door member 150 is not opened, and only the first air inlet hole 131 of the base member 130 is first opened.

Here, the first air inlet hole 131 of the base member 130 is first opened for the reason that a retracting operation of the first elastic piece 146*a* is limited by the first protrusion 137 formed in a horizontal direction on the first lower side guide hole 136 in the base member 130, and in this state the second stopper protrusion 146 is engaged by the second groove. The first elastic piece 146*a* may be retractable after the door base member 140 is fully opened.

When the first air inlet hole 131 is opened, the air flowing in through the first air inlet hole 131 flows in the rearward direction along the first air moving space 132. At this time, since the air has a high pressure, a suction force for sucking an inner air of the communicating hole 103 formed in the helmet body 100 is generated, so that the air is discharged through the first air outlet hole 134.

Therefore, in the first opening step, the inner air of the interior of the helmet is discharged to the outside. As described in the earlier description of the operation, in the first opening step, the first stopper protrusion 145 formed in the first elastic piece 145*a* may be selectively stopped by one of the multiple first grooves 135 formed in the base member 130.

When a selective stop is performed, since the opening and closing degree of the first air inlet hole 131 is different, the amount of the air to be discharged from the interior of the helmet is changed.

In the second opening step, as shown in FIGS. 11 and 12, in a state that the first opening step is maintained, the side door member 150 of the door base member 140 is retracted for thereby opening.

In a state that the door base member 140 is retracted, when the door member 150 is retracted, as shown in FIG. 11, the third air inlet hole 143 of the door base member 140 is aligned with the second air inlet hole 133 of the base member, and the first air outlet hole 134 and the second air outlet hole 144 are opened.

Therefore, the air flowing through the first air inlet hole 131 and the aligned second air inlet hole 133 and third air inlet hole 143 flows in the rearward direction through the first air moving space portion 132. In the rear side, the air flows through the second air outlet hole 144 and the second air moving space portion 153 of the side door member 150.

Since the amounts of the inlet and outlet air are large, the force pulling the air in the surrounding portion of the communication hole 103 of the helmet body 100 is increased, so that the amount of the air in the interior of the helmet which flows through the communication hole 103 is increased.

In the second opening step, the second stopper protrusion 146 formed in the second elastic piece 146*a* may be selectively stopped by one of the second grooves 154 arranged in the side door member 150.

In the above selective stop, since the opening and closing degree of the third air inlet hole 143 is different, it is possible to more accurately control the discharge of the air in the interior of the helmet.

On the contrary, when closing the air vent according to the present invention, the closing process is implemented through the second opening step in which the side door member 150 is closed, and the first opening step in which the door base member is closed.

The side door member 150 is first closed for the reason that the door base member is not closed while the side door member 150 is being opened. Namely, the retracting operation of the first elastic piece 145*a* of the door base member 140 is prevented by the second protrusion 156 of the side door member 150, and the first stopper protrusion 145 is caught by the first groove 135. Therefore, in the air vent according to the present invention, when a breath steam formation is not large, if the user wishes to gradually decrease the discharging amount of the air, it is possible to decrease the discharging amount of the air by selecting one among the first through fourth opening steps. On the contrary, when the breath steam formation of the shield is large, if the user wishes to increase the discharging amount of the air, the first and second opening steps are all performed for thereby maximizing the discharging amount of the air.

As described above, in the present invention, the air vent is installed at both lower sides of the shield of the helmet, so that the inner air is discharged based on the flow of the air of the air vent. In addition, it is possible to adjust the discharge of the air based on the first and second opening steps by a sliding operation of the door base member with respect to the base member and a sliding operation of the side door member with respect to the door base member.

Furthermore, it is possible to accurately adjust the opening degrees by dividing each of the first and second opening steps into four sub-steps, so that it is possible to accurately adjust the discharging amount of the inner air through the air vent.

Therefore, in the present invention, since it is possible to adjust the discharging amount of the inner air of the shield of the helmet based on a helmet user's condition and an inner and outer environment of the helmet, it is possible to implement an agreeable optimum state when using the helmet.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An air vent for a helmet, comprising:

a helmet body which includes a front opening portion, a shield installed in such a manner that the opening portion is openable, a pad provided in a whole inner surface, and a communicating hole which is formed at right and left sides of a jaw protection portion in a lower portion of the opening portion and communicates with the outside;

a base member which is fixed in such a manner that an outer surrounding portion of the communicating hole of the helmet body is covered, and which includes a first air inlet hole formed in a front side of the helmet, a first air moving space portion formed to communicate air to a rear side from the first air inlet hole, a second air inlet hole formed in such a manner that more air is flown into the first air moving space portion, and a plurality of first air outlet holes formed in a rear side of the air moving space portion;

a door base member which is slidable on the base member in a forward and backward direction in a state that a first inward rim closely is contacted with an outer surface of the base member and the first air inlet hole is opened and closed by a first end portion opens during the sliding, and which includes a third air inlet hole formed in an inner side of a first end portion and a second air outlet hole formed in a rear side at a certain distance from the third air inlet hole; and a side door member which is slidable on the door base member in a forward and backward direction in a state that a second inward rim is closely contacted with an outer surface of the door base member and the second air inlet hole is opened and closed by a second end portion during the sliding, and which includes a second air moving space portion in a rear side.

2. The air vent of claim 1, wherein said door base member is slidable on the base member and includes at least one pair of first engaging protrusions in an inner side surface, so that the first engaging protrusions are slidable in a forward and backward direction along a pair of first guide holes formed in the bottom of the base member.

3. The air vent of claim 1, wherein said side door member is slidable on the door base member and includes at least one pair of second engaging protrusions in an inner side surface, so that the second engaging protrusions are slidable in a forward and backward direction along a pair of second guide holes formed in the bottom of the door base member.

4. The air vent of claim 1, wherein said door base member includes a first stopper protrusion which is formed in an inward direction, and a first elastic piece adapted to provide an elastic force to the first stopper protrusion, wherein whenever the first stopper protrusion is contacted with one of more than at least three first grooves formed in an outer surface of the base member in a sliding direction at a regular interval, the door base member stops for thereby implementing a multiple step opening operation.

5. The air vent of claim 1, wherein said side door member includes more than at least three second grooves which are formed in an inner side surface in a sliding direction at a regular interval, and whenever the second grooves are contacted with a second stopper protrusion of the second elastic piece formed in an outer side surface of the door base member, the side door member is stopped, respectively, for thereby implementing a multiple step opening operation.

6. The air vent of claim 4, wherein said side door member includes a second protrusion portion for limiting a retracting operation of the first elastic piece.

7. The air vent of claim 5, wherein said base member includes a first protrusion portion in a horizontal direction for limiting a retracting operation of the second elastic piece.

* * * * *